US009797092B1

(12) United States Patent
Wedel et al.

(10) Patent No.: US 9,797,092 B1
(45) Date of Patent: Oct. 24, 2017

(54) HOT PLATE STEAM SYSTEM

(75) Inventors: Gregory L. Wedel, Kalamazoo, MI (US); Gerald L. Timm, Schoolcraft, MI (US); Kenneth C. Hill, Loudon, TN (US)

(73) Assignee: Kadant Johnson Inc., Three Rivers, MI (US)

( * ) Notice: Subject to any disclaimer, the term of this patent is extended or adjusted under 35 U.S.C. 154(b) by 1169 days.

(21) Appl. No.: 13/556,518

(22) Filed: Jul. 24, 2012

Related U.S. Application Data

(60) Provisional application No. 61/528,825, filed on Aug. 30, 2011.

(51) Int. Cl.
*D21F 5/20* (2006.01)
*B31F 1/28* (2006.01)
*D21F 5/02* (2006.01)

(52) U.S. Cl.
CPC ..... *D21F 5/20* (2013.01); *B31F 1/285* (2013.01); *D21F 5/028* (2013.01)

(58) Field of Classification Search
CPC ..... F22B 1/282; F22B 37/26; D21F 5/20
See application file for complete search history.

(56) References Cited

U.S. PATENT DOCUMENTS 1,976,730 A * 10/1934 Irwin ..... F16T 1/10 159/DIG. 13
3,861,057 A * 1/1975 Wittstock ..... F26B 13/103 156/359
4,206,802 A * 6/1980 Reed ..... B01D 53/26 122/483
4,220,194 A * 9/1980 Shade, Jr. ..... F22B 37/266 122/32
4,222,178 A * 9/1980 Moran ..... D21F 5/028 165/90
4,314,878 A * 2/1982 Lee ..... D21F 5/028 162/198
4,380,960 A * 4/1983 Dickinson ..... F01K 3/188 110/238
4,447,964 A * 5/1984 Gardner ..... D21F 5/028 34/119
4,537,655 A * 8/1985 Henriksson ..... D21C 9/185 162/23
4,700,493 A * 10/1987 Wedel ..... D21F 5/028 34/119
5,020,243 A 6/1991 Miller
5,244,518 A * 9/1993 Krayenhagen ..... B31F 1/284 156/351
5,306,331 A * 4/1994 Auvil ..... B01D 53/047 95/130
5,524,355 A * 6/1996 Schiel ..... D21F 1/48 165/90

(Continued)

*Primary Examiner* — Avinash Savani
*Assistant Examiner* — Deepak Deean
(74) *Attorney, Agent, or Firm* — Young Basile Hanlon & MacFarlane, P.C.

(57) ABSTRACT

Disclosed herein is a method and apparatus for improving the heating capacity of steam-heated hot plates, and in particular, to steam-heated hot plates used in the corrugating industry. One or more separators and thermocompressors are added to the output of the hot plates to separate blow through steam from condensate and pressurize and inject the steam back into the hot plates.

18 Claims, 3 Drawing Sheets

(56) References Cited

U.S. PATENT DOCUMENTS

| | | | | |
|---|---|---|---|---|
| 5,636,449 | A * | 6/1997 | Gaddis | F26B 11/0445 34/124 |
| 6,309,530 | B1 * | 10/2001 | Rutherford | C01D 3/06 205/516 |
| 6,782,638 | B1 * | 8/2004 | Svenland | D21F 5/028 34/124 |
| 8,215,358 | B2 | 7/2012 | Donahue et al. | |
| 2002/0036069 | A1 * | 3/2002 | Kettunen | D21C 11/06 162/47 |
| 2010/0269996 | A1 * | 10/2010 | Grattan | C02F 1/008 162/198 |
| 2010/0294377 | A1 * | 11/2010 | Aloni | F16T 1/48 137/14 |
| 2011/0277340 | A1 * | 11/2011 | Wiens | D21F 5/20 34/444 |

* cited by examiner

HOT PLATE STEAM SYSTEM

RELATED U.S. APPLICATION DATA

This application claims the benefit of U.S. Provisional Application No. 61/528,825, filed Aug. 30, 2011.

FIELD OF THE INVENTION

The invention pertains to a method and apparatus for improving the heating capacity of steam-heated hot plates, and in particular, to steam-heated hot plates used in the corrugating industry.

BACKGROUND

Corrugated containerboard is manufactured on machines that combine one or more "liners" in a stack with fluted webs ("medium") in between with the peaks of the medium flutes glued to the surfaces of the liners. The adhesive between the fluted medium and the liners of the combined board (that is, the corrugated containerboard) is then dried by passing the board through a double face heating section. The double face heating section ("double-backer") consists of a series of steam-heated "steam chests" or "hot plates". Individual steam chests and hot plates are generally less than two feet in machine direction length and extend to the width of the corrugator, which is typically 100 " to 120" in width. The containerboard is held against these steam chests and hot plates by belts and ballast rollers that serve to keep the board in good thermal contact with the top surfaces of the hot plates/steam chests.

FIG. 1 shows a steam chest 10 according to the prior art. FIG. 2 shows a hot plate according to the prior art. Steam chests 10 and hot plates 40 are examples of steam heating devices designed to transfer heat from steam to a heating surface. Steam chests 10 can be constructed as large metal boxes 12 that are designed to hold the steam input at "A" the box interior 16 under pressure. The steam condenses on the top inside surface of the box 12 and the condensed steam ("condensate") falls onto and collects on the bottom of the box 12. From there, the condensate is drained by gravity to a steam trap 22 from which the condensate is returned to the boiler at "B." The box upper surface 14 is in contact with a containerboard 15 to be dried, which is held down to the upper surface 14 by a belt 20. Steam chests 10 are conventionally heated by steam that is supplied under pressure to each of the steam chests. The steam pressure to each group of steam chests 10 is typically controlled by a pressure control valve (not shown) working in conjunction with a pressure transmitter and a pressure indicating controller.

FIG. 2 shows the "hot plate" 40 (herein distinguished from the "steam chest" 10), which is similar in function to the steam chest 10, except the hot plate 40 has drilled internal passages 44 adjacent to a hot plate surface 46. The hot plate surface 46 and internal passages 44 are formed as part of a hot plate frame 42. These passages 44 generally extend from one side of the hot plate frame 42 to the opposite side, and then back again, forming several loops before the passage leaves the plate. The steam flows into inlet 43 and through these internal passages 44 and condenses as it transfers its heat to a corrugated containerboard 48 on the outside of surface 46. The condensate flows slowly by gravity toward a drain 45. The drain line is conventionally connected to a steam trap. Steam traps open to drain the condensate from the hot plate and then close to prevent the passage of uncondensed steam. The condensate that leaves the steam trap is returned to the boiler. At high condensing rates, the condensate that forms inside the passages of the hot plates 40 tends to accumulate and result in a reduction in rate and uniformity of heat transfer. The corrugated containerboard 48 can be held down to the hot plate surface 46 by a belt 50.

A typical corrugated containerboard making machine 300 with its associated double backer section 314 is shown in FIG. 3. The corrugated containerboard making machine 300 includes supply rollers 302 for the first liner, supply rollers 304 for the medium and supply rollers 306 for the second liner. The corrugated containerboard making machine 300 also includes a corrugator 308, drive rollers 310 and adhesive applicator 312. The corrugated containerboard making machine also includes a hot plates section 318 in a double backer section 314 for drying the adhesive applied at 312.

In order to minimize the non-uniformity of heat transfer, a multitude of hot plates are used in each double backer section 314. The pressure is adjusted on the belt 316 that holds the board to the hot plates 318 in an attempt to correct for these reductions in rate and uniformity of heat transfer. In conventional corrugators, the hot plate performance is controlled by the belt pressure, adding backing rolls, loading the backing rolls, increasing the steam pressure, venting some steam to atmosphere, adding more hot plates, or running the corrugating machine at a slower speed.

An example of prior art hot plates and their steam control system 400 are shown in FIG. 4. FIG. 4 shows a steam line 402 inputting steam at "A." The steam line 402 delivers steam either directly to a hot plate 408 via delivery lines 414 or to pressure control valves 404, 406, which regulate the steam pressure and deliver steam to hot plates 410, 412 via delivery lines 416, 418. The steam heats the hot plates 408, 410, 412 and condenses, forming a condensate that is collected by condensate trap lines 420, 422, 424 and carried to separators 426, 428 which separate condensate from steam and return separated steam to the delivery lines 416, 418 or directly to a pump 432. Condensate is routed to pumps 430, 432 to be returned to the steam boiler (not shown) via a return line 434 at "B."

The prior art hot plates and their steam systems are not suitable for high-speed corrugated boxboard production where uniformity, high heat transfer rates, and energy efficiency are important.

SUMMARY OF THE INVENTION

Aspects of disclosed embodiments include an improved method for transferring heat from a steam heating device including introducing steam into the steam heating device with a steam supply system; circulating the steam through the steam heating device creating steam condensate and collecting the steam and steam condensate with a separator tank which separates the steam from the steam condensate; returning the steam condensate to the boiler to be reheated; returning the steam to a thermocompressor which heats and pressurizes the steam and introduces it back into the steam supply system; and wherein the steam heating device includes a ratio of steam to steam condensate of at least 20:1 by volume.

Aspects of disclosed embodiments also include an apparatus for transferring heat from a steam heating device including a steam supply system for supplying steam; a steam heating device; a separator tank which separates the steam from the steam condensate; a thermocompressor which heats and pressurizes the steam and introduces it back into the steam supply system; and wherein the steam heating device includes a ratio of steam to steam condensate of at least 20:1 by volume.

DETAILED DESCRIPTION

The method and apparatus of the subject disclosure includes a steam-heated hot plate of the type typically used in the double-face heating section of machines that manufacture corrugated board, a steam pressure transmitter, a steam pressure indicator controller, a steam and condensate separator tank, a blow-down valve, a steam jet thermocompressor, and a pressure powered condensate pump.

The subject disclosure is applicable both to steam chests and to hot plates. Steam chests and hot plates can be referred to collectively as steam heating devices. If, when the steam chests or hot plates are first heated, the residual non-condensing gases (mostly air) are not purged, this can result in a further reduction in rate and uniformity of heat transfer. Steam heating devices can be equipped with a trap or separator which separates the live steam from condensed steam (water). In order to help purge air from the steam heating devices, a small line or passageway can be installed around the trap to by-pass the trap and allow "live" (uncondensed) steam to purge the air. The discharge of the live steam, however, gives rise to poor thermal efficiency and lack of process control. This escape of live steam with residual non-condensing gasses is called blow through.

Further, the collection of sub-cooled condensate in the bottom of the steam chest or on the bottom of the cross-machine flow passages of the hot plate gives rise to a thermal bowing of the heaters. This thermal bowing causes non-uniform thermal contact between the steam chest/hot plate surfaces and the corrugated container board which in turn results in non-uniform setting of the adhesive bonds.

In an embodiment of this disclosure, a steam pressure indicating controller maintains the desired steam pressure in the header that feeds one or more of the hot plates in the double-backer section. The drain line from the hot plate(s) discharges to the steam and condensate separator. The condensate is returned to the boiler through the pressure powered condensate pump. The blow through steam from the separator is piped to the suction port of the thermocompressor from where it is boosted in pressure by the thermocompressor and recirculated back to the supply header for the hot plate section. With this concept, the entire blow through steam is re-used.

Figure 1:
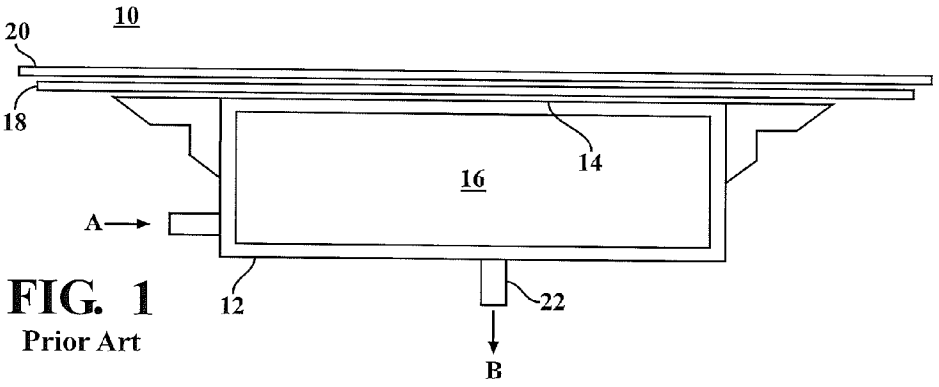
FIG. 1 Prior Art
FIG. 1 is a diagram of a prior art steam box.
Figure 2:
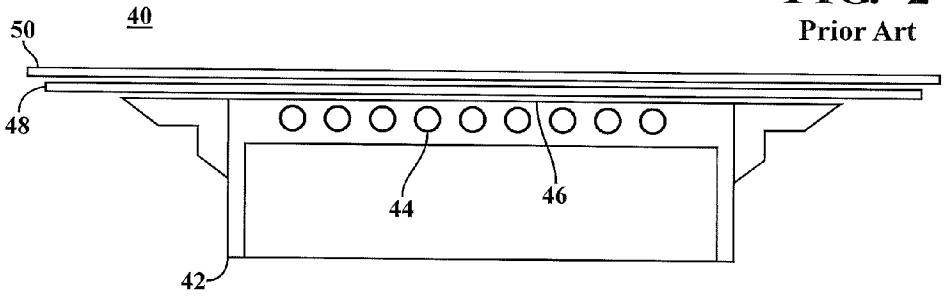
FIG. 2 Prior Art
FIG. 2 is a diagram of a prior art hot plate.
Figure 3:
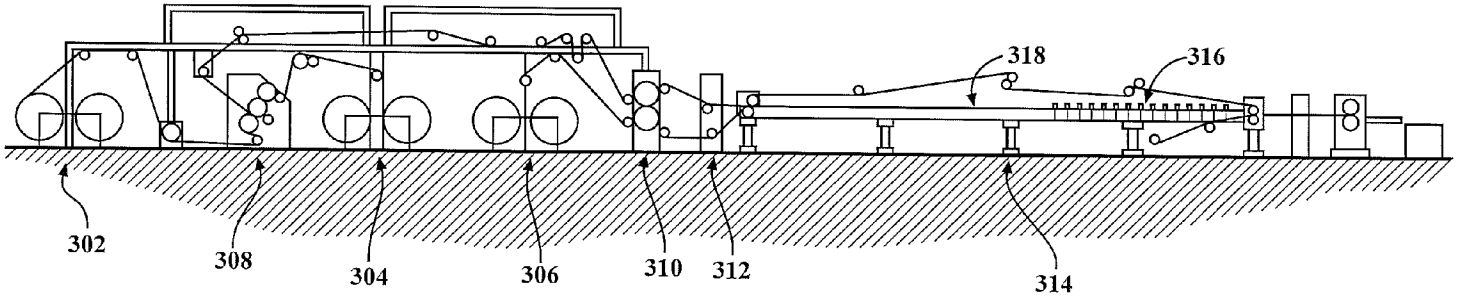
FIG. 3 Prior Art
FIG. 3 is a diagram of a prior art corrugating system.
Figure 4:
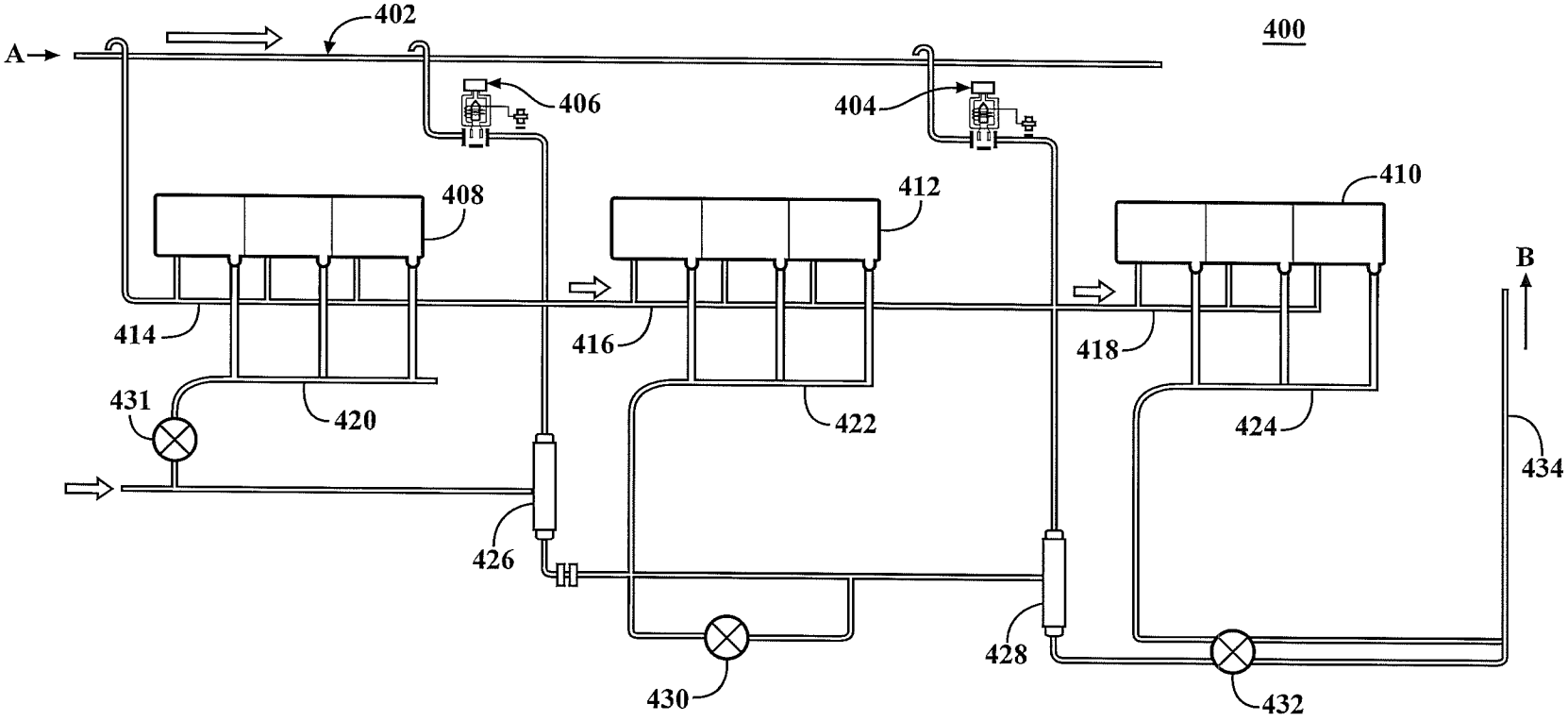
FIG. 4 Prior Art
FIG. 4 is a diagram of a prior art steam control system.
Figure 5:
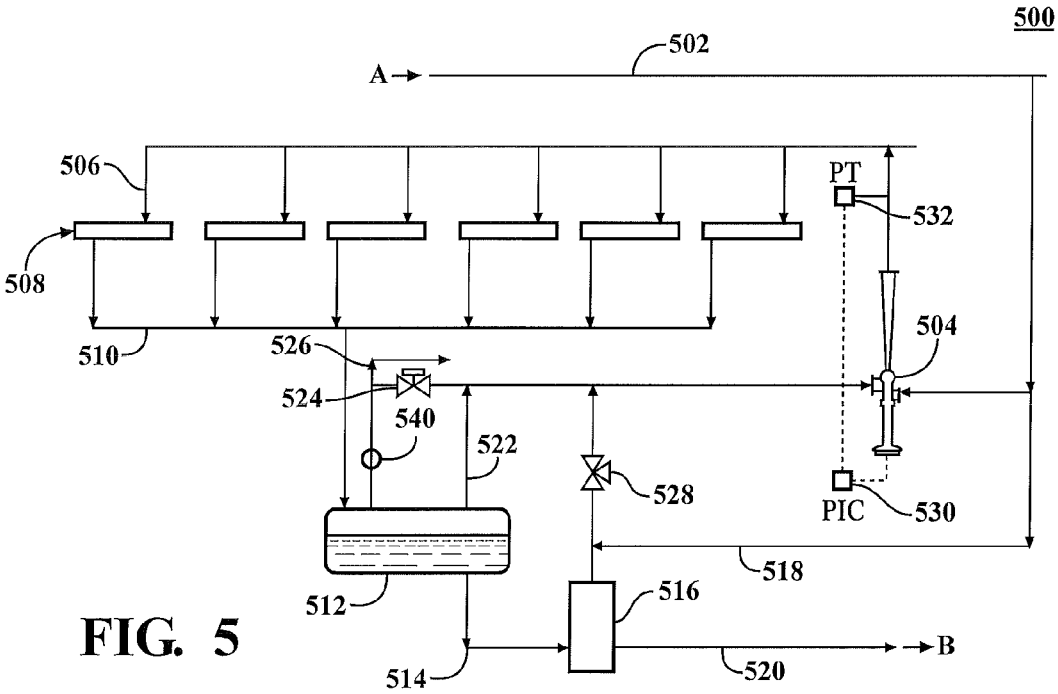
FIG. 5 is a diagram of a steam control system according to disclosed embodiments.

FIG. 5 is a diagram showing a steam control system 500 for supplying steam to a number of steam heating devices, in this example hot plates 508. The steam pressure indicating a controller 530 is used to maintain a hot plate header 506 pressure. This is accomplished by modulating the actuator on a thermocompressor 504 using the controller 530. The controller 530 is connected to a transducer 532 which can measure steam pressure and temperature. Steam enters a high pressure steam input 502 at "A" and is routed to the thermocompressor 504 and a blow down valve 528 via a line 518. Steam from the high pressure steam input 502 is combined with pressurized circulated steam at the thermocompressor 504 an routed to the hot plate header 506, which distributes the steam to the hot plates 508, under the direction of the controller 530.

The steam circulates through the hot plates 508 and partially condenses. The circulated steam and condensate is output from the hot plates 508 through the return lines 510. The return lines 510 route the circulated steam and condensate to a separator tank 512 where circulated steam is separated from condensate. The condensate is removed from the separator tank 512 via condensate line 514 to pump 516, which pumps the condensate back to the steam boiler (not shown) via line 520 in direction "B".

Circulated steam exits the separator tank 512 via re-circulation line 522 which can, in cooperation with valves 524 and 528, permit the system to blow-down at start up to remove non-condensable gasses from the hot plates. Otherwise the circulated steam is returned to the thermocompressor 504 via the re-circulation line 522 to be pressurized and blended in with the new steam arriving from the high pressure steam header 502 to be returned to the hot plate header 506 and thereby to the hot plates 508.

In FIG. 5, the amount of blow through flow and the differential steam pressure across the hot plates 508 depend on the operation of the thermocompressor 504 and are not primary control parameters. The thermocompressor 504 ensures the drainage of condensate from the hot plate(s) 508 and maintains high and uniform heat transfer from the hot plates 508 by a continuous and appropriate flow of blow through steam through the hot plate section.

Figure 6:
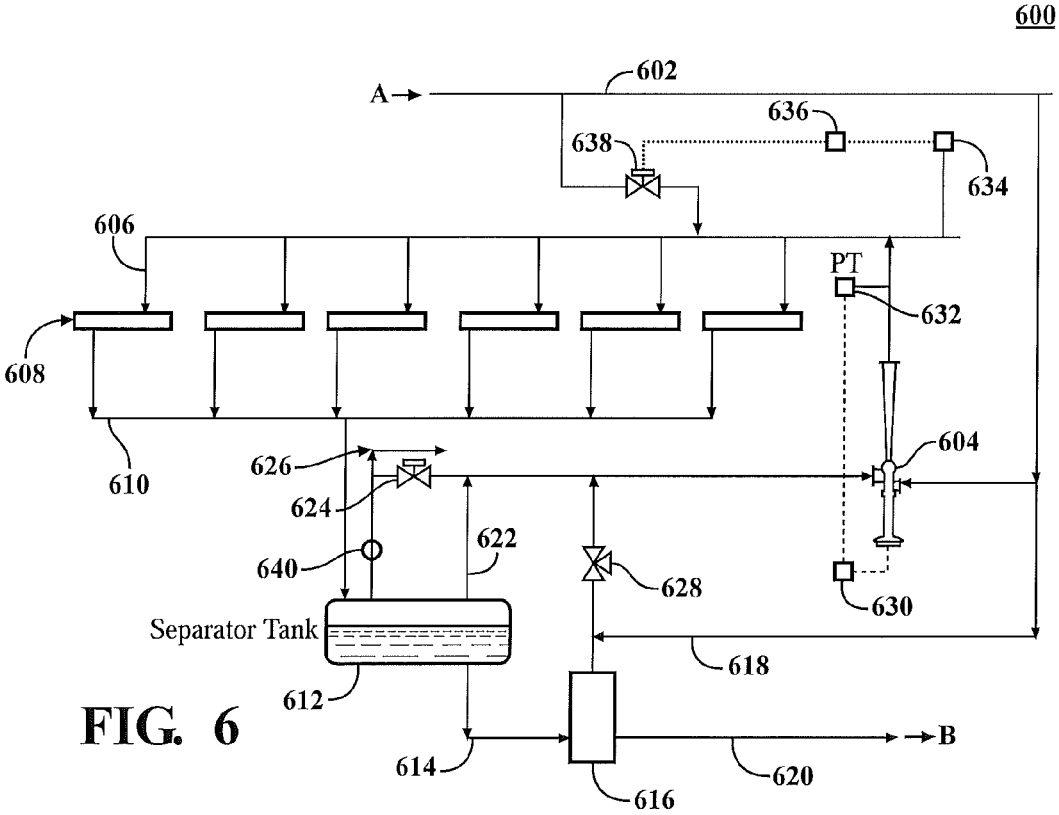
FIG. 6 is a diagram of a steam control system according to disclosed embodiments.

FIG. 6 shows another disclosed embodiment of a steam supply system 600. In FIG. 6, the amount of blow through flow and the differential steam pressure across hot plates 608 are alternatively selected as control parameters for a thermocompressor 604. The steam pressure in a hot plate steam supply header 606 is controlled directly by a steam pressure control valve 638. The thermocompressor 604 set point ensures the drainage of condensate from the hot plate(s) 608 and maintains high and uniform heat transfer from the hot plates 608 by a continuous and appropriate flow of blow through steam through the hot plate section.

The thermocompressor 604 is supplied with steam at a pressure that is equal to or suitably higher than the steam supply header 606 to the hot plates 608. The high pressure ("motive") steam that is supplied to the thermocompressor 604 is mixed with the low pressure steam from a separator tank 612 and discharges the mixture to the steam supply header 606 at a pressure that is at least as high as the steam supply header 606. The thermocompressor 604 mixes high pressure steam from a high pressure steam inlet 602 with pressurized circulated steam from the separator tank 612 under the control of a differential pressure transmitter 630, which gets information from a digital pressure transducer 632. The output of the thermocompressor 604 is controlled by the control valve 638 that mixes high pressure steam from the high pressure steam inlet 602 with pressurized circulated steam under the control of a pressure indicating controller 636, which gets information from a pressure transducer 636.

Circulated steam and condensate exit the hot plates 608 via return lines 610 which route the circulated steam and condensate to the separator tank 612, which separates the circulated steam from the condensate. The condensate is sent through condensate line 614 to a pump 616, which pumps the condensate back to the steam boiler (not shown) via boiler return line 620. Circulated steam is routed from the separator tank 612 via steam return line 622. The returning steam can be routed through valve 624 to blow down line 626 to blow down the system upon start-up or be routed to thermocompressor 604.

This method and apparatus maintains a flow of blow through steam that is by volume that can be 20-30 times higher than the condensate flow volume. This high volume of steam quickly purges the hot plate section 608 of all non-condensable gases, flushes the condensate through the passages in the hot plate 608 to decrease the amount of sub-cooled water that is in the passages, and prevents passages from flooding with condensate, thermally bowing, and losing heat transfer.

This concept allows the simultaneous achievement of high and uniform heat transfer and high operating efficiency, because the high volume of blow through steam is reused in the hot plate section 608. Still further, this concept can quickly purge non-condensable gases from the heaters and reduce the amount of sub-cooled condensate in the heaters that would otherwise cause thermal bowing of the heaters and the corresponding loss of adhesive bond uniformly.

In an embodiment of this disclosure, the discharge from the thermocompressor 604 can be directed to the hot plate steam header of a down-stream hot plate section (not shown). This would be termed a "cascade thermocompressor system." Embodiments of this disclosure include aspects in which the differential pressure transmitter 630 of FIG. 6 is configured to measure the pressure drop across an appropriate orifice plate (not shown) in the uncondensed steam (blow through) line 622 so that the position of the control spindle in the thermocompressor 604 will be adjusted to maintain a fixed flow rate of uncondensed steam.

A further feature of the subject invention is the addition of a blow-down system to facilitate the start-up of the corrugator by purging air and other non-condensable gases from the corrugator system. This is accomplished by suitable control of the blow-down valves 524, 624 that discharge as shown in FIGS. 5 and 6 to blow-down lines 526, 626. A suitable thermostatic trap 540, 640 is used to clear non-condensable gases from the separator tank 512, 612 intermittently directing the discharge flow as needed to the blow-down lines 526, 626.

The above-described implementations have been described in order to allow easy understanding of the present invention and do not limit the present invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. An apparatus for transferring heat to a steam heated device comprising:

a single high pressure steam header that for receiving and supplying steam from a steam boiler;

a steam heating device header;

a steam heated device that receives steam from the steam heating device header and discharges circulated steam and condensate;

a separator tank in communication with the steam heated device, wherein the separator tank receives the circulated steam and condensate from the steam heated device and separates the circulated steam from the condensate;

a thermocompressor in communication with the separator tank and the high pressure steam header, wherein the thermocompressor receives the circulated steam from the separator tank, blends the circulated steam with the steam from the high pressure steam header, and feeds the blended steam to the steam heating device header, and wherein the thermocompressor is capable of maintaining a flow of steam through the steam heated device at a ratio of steam to steam condensate of at least 20:1 by volume;

a first blow down valve in communication with the high pressure header for controlling the addition of steam to the circulated steam from the separator tank prior to reaching the thermocompressor; and a blow down line in communication with the separator tank for purging non-condensable gases and having a second blow down valve for selecting between directing the non-condensable gases to vent to atmosphere or combining with the circulated steam prior to reaching the thermocompressor.

2. The apparatus of claim 1, wherein the thermocompressor is capable of maintaining the flow of the steam through the steam heated device at a ratio of steam to steam condensate of at least 30:1 by volume.

3. The apparatus of claim 1, wherein the thermocompressor is capable of maintaining the flow of the steam through the steam heated device at a rate of at least 0.20 times mass flow rate of steam condensate.

4. The apparatus of claim 1, wherein the thermocompressor is capable of maintaining a fixed pressure in the steam heating device header.

5. The apparatus of claim 1, wherein the thermocompressor is capable of maintaining a fixed differential pressure between the steam heating device header and the discharge from the steam heated device.

6. The apparatus of claim 1, further comprising: a thermostatic trap in communication with the blow down line to purge non-condensable gases.

7. The apparatus of claim 1, further comprising: a controller capable of modulating an actuator on the thermocompressor; and a transducer in communication with the controller to assist with modulating the actuator of the thermocompressor, wherein the transducer measures steam pressure.

8. The apparatus of claim 1, wherein the steam heated device is a steam chest.

9. The apparatus of claim 1, wherein the steam heated device is a steam heated hot plate.

10. An apparatus for transferring heat to a steam heated device comprising:

a single high pressure steam header that receives and supplies steam from a steam boiler;

a steam heating device header;

a steam heated device that receives steam from the steam heating device header and discharges circulated steam and condensate;

a separator tank in communication with the steam heated device, wherein the separator tank receives the circulated steam and condensate from the steam heated device and separates the circulated steam from the steam condensate; and a thermocompressor in communication with the separator tank and the high pressure steam header;

a recirculation line for communicating circulated steam from the separator tank to the thermocompressor, wherein the thermocompressor receives the circulated steam, blends the circulated steam with the steam from the high pressure steam header, and feeds the blended steam to the steam heating device header, and wherein the thermocompressor is capable of maintaining a flow of steam through the steam heated device at a ratio of steam to steam condensate of at least 20:1 by volume;

a first blow down valve in communication with the high pressure header for controlling the addition of steam to the circulated steam from the separator tank prior to reaching the thermocompressor;

a blow down line in communication with the separator tank for purging non-condensable gases and having a second blow down valve for selecting between directing the non-condensable gases to vent to atmosphere or combining with the circulated steam prior to reaching the thermocompressor; and a steam pressure control valve for bypassing steam from the high pressure steam header to the steam heating device header, wherein the steam pressure control valve is moveable between a first position, where the steam is directed to the high pressure header, and a second position, where the steam is directed to the thermocompressor.

11. The apparatus of claim 10, wherein the thermocompressor is capable of maintaining the flow of steam through the steam heated device at a ratio of steam to steam condensate of at least 30:1 by volume.

12. The apparatus of claim 10, wherein the thermocompressor is capable of maintaining the flow of steam through the steam heated device at a rate of at least 0.20 times mass flow rate of steam condensate.

13. The apparatus of claim 10, wherein the thermocompressor is capable of maintaining a fixed pressure in the steam heating device header.

14. The apparatus of claim 10, wherein the thermocompressor is capable of maintaining a fixed differential pressure between the steam heating device header and the discharge from the steam heated device.

15. The apparatus of claim 10, wherein the blow down line includes a thermostatic trap to assist with the purge of non-condensable gases.

16. The apparatus of claim 10, further comprising:

a controller capable of modulating an actuator on the thermocompressor; and a transducer in communication with the controller to assist with the modulating of the actuator of the thermocompressor, wherein the transducer measures steam pressure.

17. The apparatus of claim 10, wherein the steam heated device is a steam chest.

18. The apparatus of claim 10, wherein the steam heated device is a steam heated hot plate.

* * * * *